US008390659B2

(12) United States Patent
Masuda

(10) Patent No.: US 8,390,659 B2
(45) Date of Patent: Mar. 5, 2013

(54) THERMAL PRINTER AND CONTROL METHOD THEREOF

(75) Inventor: Ken Masuda, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 75 days.

(21) Appl. No.: 13/029,250

(22) Filed: Feb. 17, 2011

(65) Prior Publication Data

US 2011/0216148 A1 Sep. 8, 2011

(30) Foreign Application Priority Data

Mar. 8, 2010 (JP) ..... 2010-51005

(51) Int. Cl.
*B41J 2/32* (2006.01)
*B41J 3/60* (2006.01)

(52) U.S. Cl. ..... 347/171

(58) Field of Classification Search ..... 347/171; 400/82, 188, 120.01
See application file for complete search history.

(56) References Cited

U.S. PATENT DOCUMENTS 7,782,349 B2 * 8/2010 Baba et al. ..... 347/171
7,973,812 B2 * 7/2011 Masuda ..... 347/171

FOREIGN PATENT DOCUMENTS

JP 03-013372 1/1991
JP 11-138953 5/1999

* cited by examiner

*Primary Examiner* — Huan Tran
(74) *Attorney, Agent, or Firm* — Turocy & Watson, LLP

(57) ABSTRACT

Embodiments described herein are to a printer which includes a first head configured to print a first data set on a first side of a paper being conveyed along a paper path, and a second head configured to print a second data set on a second side of the paper being conveyed along the paper path. The printer further includes a sensor provided at an upstream side of the first and second heads in the paper feeding direction along the paper path and configured to detect an end portion of the paper being conveyed along the paper path. The printer further includes a control unit, when the end portion of the paper is detected by the sensor, configured to allow the first and second heads to continue a printing operation until the first and second data sets are printed on the remaining portion of the paper.

20 Claims, 7 Drawing Sheets

THERMAL PRINTER AND CONTROL METHOD THEREOF

CROSS-REFERENCE TO RELATED APPLICATIONS

This application is based upon and claims the benefit of priority from Japanese Patent Application No. 2010-051005, filed on Mar. 8, 2010, the entire contents of which are incorporated herein by reference.

FIELD

Embodiments described herein relate generally to a thermal printer in which a thermal paper having thermo-sensitive layers formed on both sides thereof is employed, and a control method of the thermal printer.

BACKGROUND

In the related art, there is known a thermal printer in which a thermal head is installed along a paper path through which a thermal paper having a thermo-sensitive layer formed thereon is conveyed. In such a thermal printer, the thermal head may print data on the thermal paper, which is wound in a roll loaded in a main body of the thermal printer. When printing onto the thermal printer, a leading end of the rolled thermal paper is drawn from the main body along the paper path and discharged to the exterior through a paper outlet formed on the thermal printer.

In the thermal printer according to the related art, a sensor that detects the presence of the thermal paper on the paper path may be installed at the upstream side of the thermal head in a paper feeding direction. When the rolled thermal paper runs out, upon detection of an end portion thereof by the sensor, printing is suspended and the thermal printer enters a standby mode where a user is prompted to load a new roll of thermal paper.

For instance, a printer may be employed to print transaction data produced by an ATM (Automatic Teller Machine) onto thermal paper (on a transaction basis) and issue a receipt with the transaction data printed thereon. In such a printer, when the rolled thermal paper runs out during printing, the printer may suspend the printing and wait for loading of a new roll of thermal paper. Then, the printer may resume the printing after the new roll of thermal paper is loaded. However, this may cause some inconvenience to the user because the above-described process delays providing the user with the printed receipt.

In addition, the printer may issue a partially-printed receipt in situ. Then, the printer may print the remaining data on a new roll of thermal paper that is loaded after it is detected that the paper ran out, and the printer may then issue an additional receipt with the remaining date printed thereon. Issuance of such two sheets of receipt is inconvenient for a user.

DETAILED DESCRIPTION

According to one embodiment, a printer includes a first head configured to print a first data set on a first side of a paper being conveyed along a paper path, and a second head configured to print a second data set on a second side of the paper being conveyed along the paper path. The printer further includes a sensor provided at an upstream side of the first and second heads in the paper feeding direction along the paper path and configured to detect an end portion of the paper being conveyed along the paper path. The printer further includes a control unit, when the end portion of the paper is detected by the sensor, configured to allow the first and second heads to continue a printing operation until the first and second data sets are printed on the remaining portion of the paper.

Figure 1:
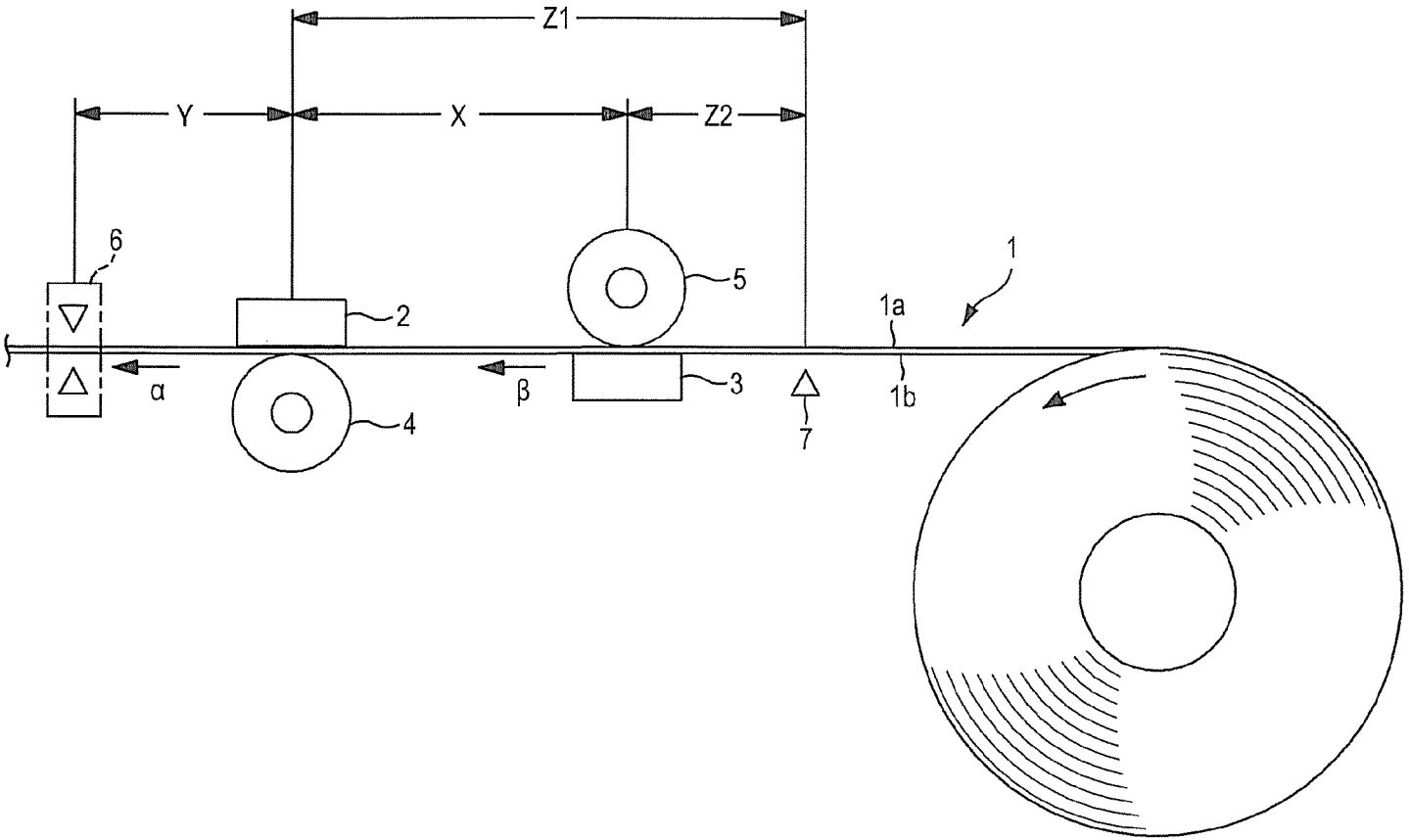
FIG. 1 is a side elevational view showing a thermal printer according to an illustrative embodiment.

Embodiments will now be described in detail with reference to the drawings. FIG. 1 is a side elevational view showing an illustrative embodiment of a thermal printer. As shown in FIG. 1, a thermal paper 1 wound in a roll shape, called a double-sided thermal paper, has thermo-sensitive layers formed on one face (hereinafter referred to as "obverse side") 1*a* and the other face (hereinafter referred to as "reverse side") 1*b*, respectively. As the printer performs a printing operation, a leading end of the thermal paper 1 is discharged in an α-direction (as indicated by arrow in FIG. 1, which is hereinafter referred to as "paper path") by means of a paper feeding mechanism 16, which will be described later. The thermo-sensitive layer, as described above, may be formed by a material which may develop as a black or red color when it is heated at a predetermined temperature or higher.

The thermal printer includes a first thermal head 2 provided to be in contact with the obverse side 1*a* of the thermal paper 1, and a second thermal head 3 provided to be in contact with the reverse side 1*b* of the thermal paper 1. The first and second thermal heads 2 and 3 each may have an elongated shape extending in a direction perpendicular to a paper feeding direction β of the thermal paper 1, and may be spaced apart from each other in the paper feeding direction β. The second thermal head 3 may be provided at the upstream side of the first thermal head 2 in the paper feeding direction β. The thermal printer further includes a first platen roller 4, which is provided opposite the first thermal head 2 with the thermal paper 1 interposed therebetween so that the thermal paper 1 is placed in close contact with the first thermal head 2. The thermal printer further includes a second platen roller 5, which is provided opposite the second thermal head 3 with the thermal paper 1 interposed therebetween so that the thermal paper 1 is placed in close contact with the second thermal head 3. The thermal printer further includes a cutter 6 configured to cut the thermal paper 1 that is being discharged along the paper path. The cutter 6 may be provided at the downstream side of the first thermal head 2 in the paper feeding direction β.

In FIG. 1, X represents a distance (or a length of the paper path) between the second thermal head 3 and the first thermal head 2 while Y represents a distance between the first thermal head 2 and the cutter 6.

The thermal printer further includes a sensor 7 configured to detect the end portion 1*e* (see FIG. 6) of the thermal paper 1, which is provided between the second thermal head 3 and a paper container configured to accommodate the thermal paper 1 therein along the paper path. In one embodiment, the sensor 7 may be a reflective photo sensor. Z1 refers to a distance (or a length of the paper path) between the sensor 7 and the first thermal head 2. Z2 refers to a distance between the sensor 7 and the second thermal head 3. The sum of the distances Z1 and Z2 indicates a length of a printing area on which at least one unit of printing data D0 can be printed.

Figure 2:
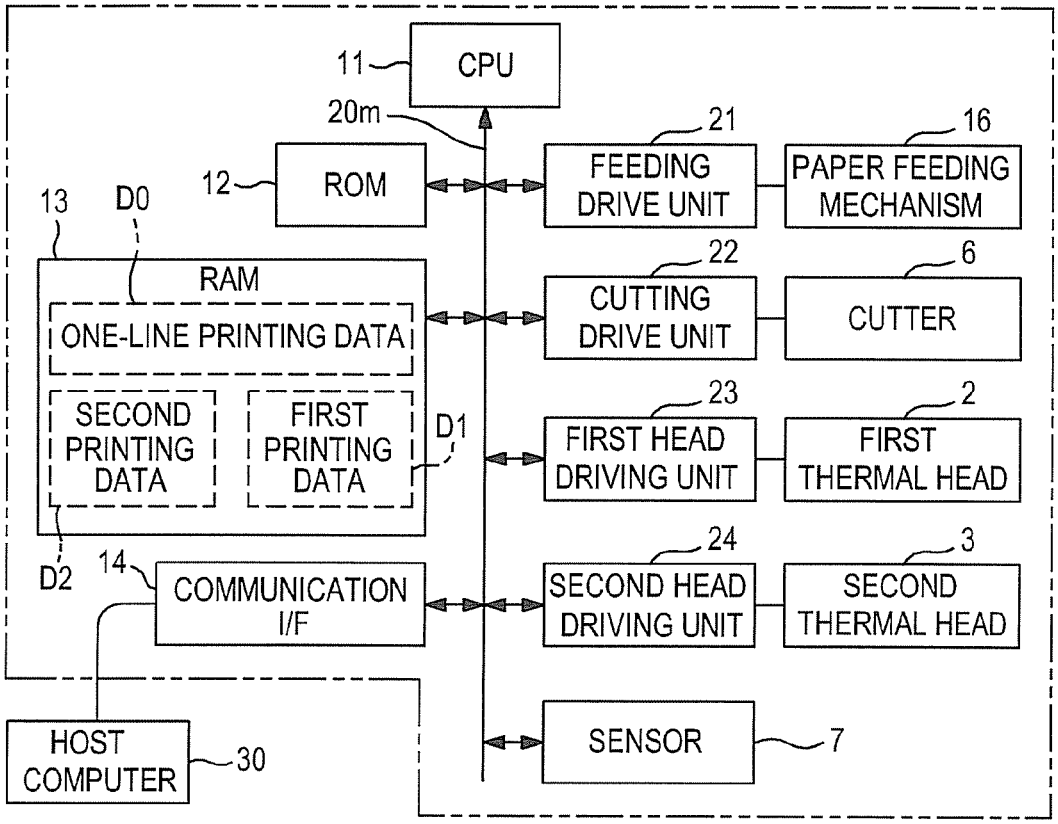
FIG. 2 is a functional block diagram showing a configuration of a main body of a thermal printer according to an illustrative embodiment.

FIG. 2 is a functional block diagram showing a configuration of a main body of a thermal printer according to one embodiment. As shown in FIG. 2, the main body of the thermal printer includes a CPU 11 (as a main control unit) configured to control the entire operation of the thermal printer, a ROM 12 configured to store control programs therein, a RAM 13 configured to store operation programs or control information therein. The main body of the thermal printer further includes a communication interface (I/F) 14 configured to perform data communication with an external host computer 30, a feeding drive unit 21 configured to drive the paper feeding mechanism 16 for supplying the thermal paper 1, and a cutting drive unit 22 configured to drive the cutter 6. The main body of the thermal printer further includes a first head driving unit 23 configured to drive the first thermal head 2, a second head driving unit 24 configured to drive the second thermal head 3, and the sensor 7. The above-described components of the main body are connected to each other via a bus 20*m*. The first head driving unit 23 drives the first thermal head 2 to print information based on a first printing data D1, which will be described later. The second head driving unit 24 drives the second thermal head 3 to print information based on a second printing data D2, which will be described later.

The CPU 11 may include the following modules that perform its major functions. The CPU 11 may include a conversion control module configured to convert the printing data D0 received from the external host computer 30 into the first printing data D1 to be printed on the obverse side 1*a* of the thermal paper 1 and the second printing data D2 to be printed on the reverse side 1*b* of the thermal paper 1. These printing data D0, D1 and D2 may be stored in the RAM 13. The CPU 11 may further include a driving control module configured to control the first and second thermal heads 2 and 3 to print information based on the first and second printing data D1 and D2, respectively. The CPU 11 may further include a printing control module, when the end portion 1*e* of the thermal paper 1 is detected by the sensor 7 during printing of one-unit data, configured to control the printing to be performed by the first and second thermal heads 2 and 3 until the one-unit data is completely printed on the thermal paper 1.

Figure 3:
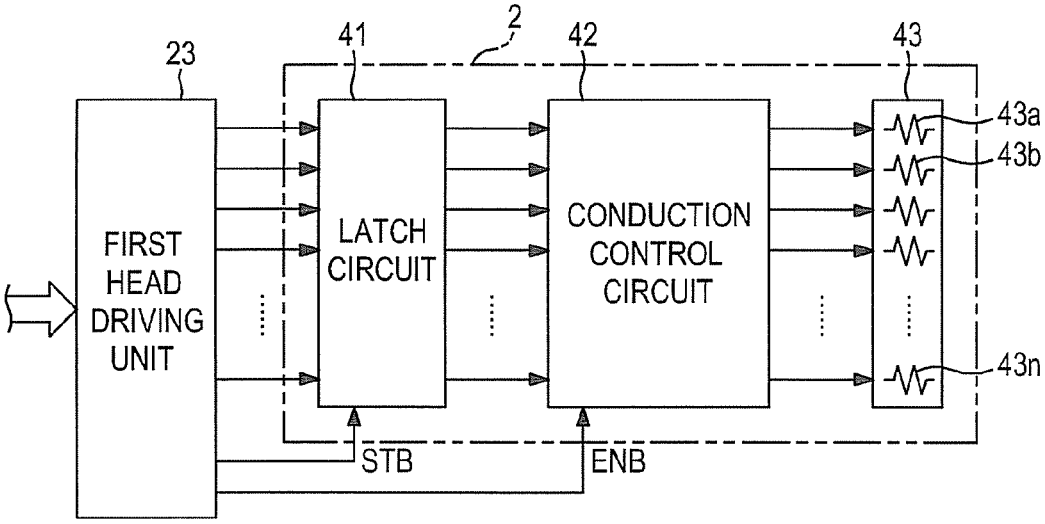
FIG. 3 is a detailed block diagram showing a thermal head according to an illustrative embodiment.

FIG. 3 is a detailed block diagram showing a thermal head according to one embodiment. As shown in FIG. 3, the first thermal head 2 may include a latch circuit 41, a conduction control circuit 42, and a heating element group 43. The heating element group 43 may include a plurality of heating elements 43*a* to 43*n* each used for thermal transfer, which are arranged in a line. The latch circuit 41 latches respective lines of data for, e.g., the first printing data D1 provided from the first head driving unit 23, in response to a strobe signal STB provided from the first head driving unit 23. The conduction control circuit 42 selectively conducts each of the heating elements 43*a* to 43*n* of the heating element group 43 based on each line of data latched by the latch circuit 41 while an enable signal ENB provided from the first head driving unit 23 is active. The second thermal head 3 has the same configuration as that of the first thermal head 2, so a description thereof will be omitted in the present disclosure.

In the following, the operation of the thermal printer will be described in detail. If the CPU 11 receives printing data D0 corresponding to one-unit data, which is associated with one transaction at, for example, ATM, from the host computer 30 through the communication I/F 14, the CPU 11 stores the received data in the RAM 13. Upon completion of storing the data, the printing data D0 may be converted into the first printing data D1 and the second printing data D2. One example of the printing data conversion is illustrated in FIG. 4.

Figure 4:
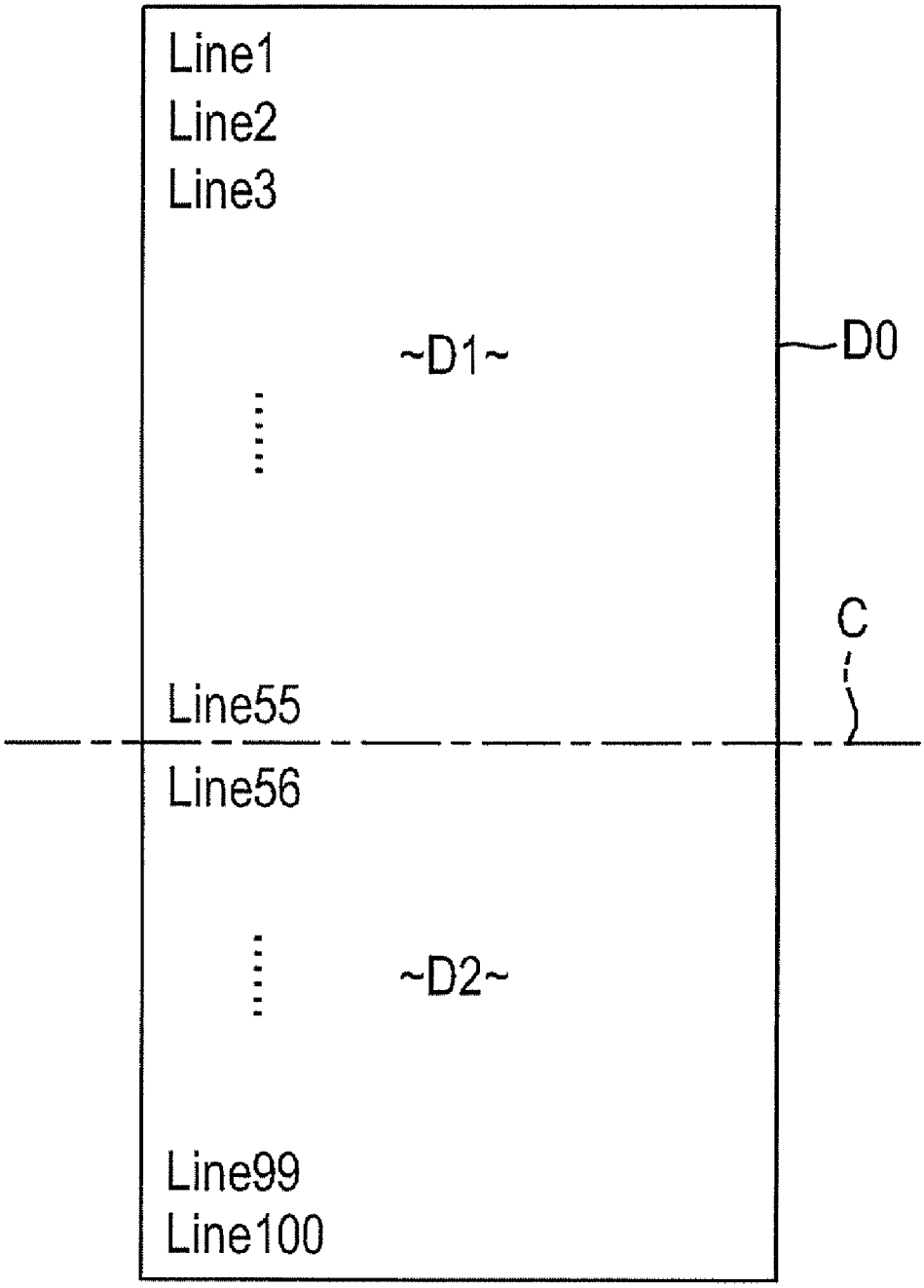
FIG. 4 is a conceptual view showing format of printing data D0 according to an illustrative embodiment.

For example, as shown in FIG. 4, the printing data D0 including 1st to 100th lines of printing data may be converted into the first printing data D1 including 1st to 55th lines of printing data and the second printing data D2 including 56th to 100th lines of printing data, which is made based on a boundary position C. The converted first and second printing data D1 and D2 are stored in the RAM 13.

Criteria for the above-described printing data conversion process may be defined based on the distance Z1 between the sensor 7 and the first thermal head 2, and the distance Z2 between the sensor 7 and the second thermal head 3.

After the printing data conversion process, the CPU 11 controls the feeding drive circuit 21 to drive the feeding of the thermal paper 1 along the paper path, and drives the first thermal head 2 associated with printing of the first printing data D1 so that 1st to 55th lines of the printing data is printed on the obverse side 1*a* of the thermal paper 1. Similarly, the CPU 11 drives the second thermal head 3 associated with printing of the second printing data D2 so that 56th to 100th lines of the printing data is printed on the reverse side 1*b* of the thermal paper 1.

Figure 5:
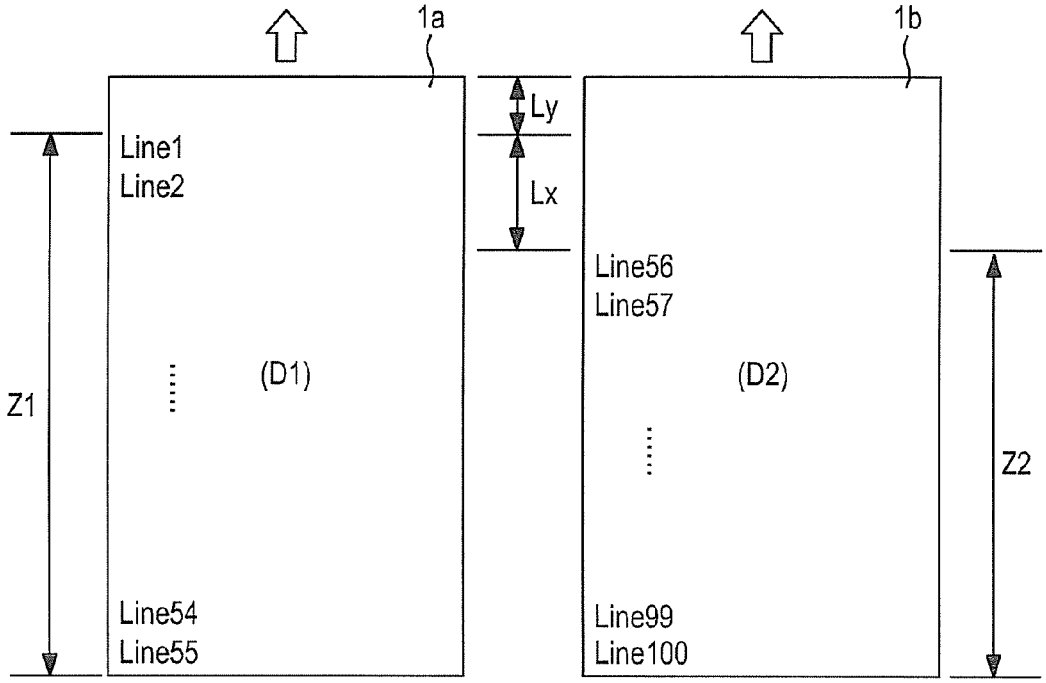
FIG. 5 is a conceptual view showing a printed result for the printing data D0 according to an illustrative embodiment.

By performing the above-described process, as shown in FIG. 5, 1st to 55th lines of the printing data included in the first printing data D1 may be printed on the obverse side 1*a* of the thermal paper 1, while 56th to 100th lines of the printing data included in the second printing data D2 may be printed on the reverse side 1*b* of the thermal paper 1. On a leading end portion of the obverse side 1*a*, a blank area Ly may be provided which corresponds to the distance Y between the cutter 6 and the first thermal head 2. In addition, on a leading end portion of the reverse side 1*b*, a blank area Lx may be provided which corresponds to the distance X between the first thermal head 2 and the second thermal head 3.

The thermal paper 1, which is printed with the information as described above, may be cut by the cutter 6 to be issued to a user as one-sheet of receipt on which one transaction data generated at an ATM machine is recorded.

Figure 6:
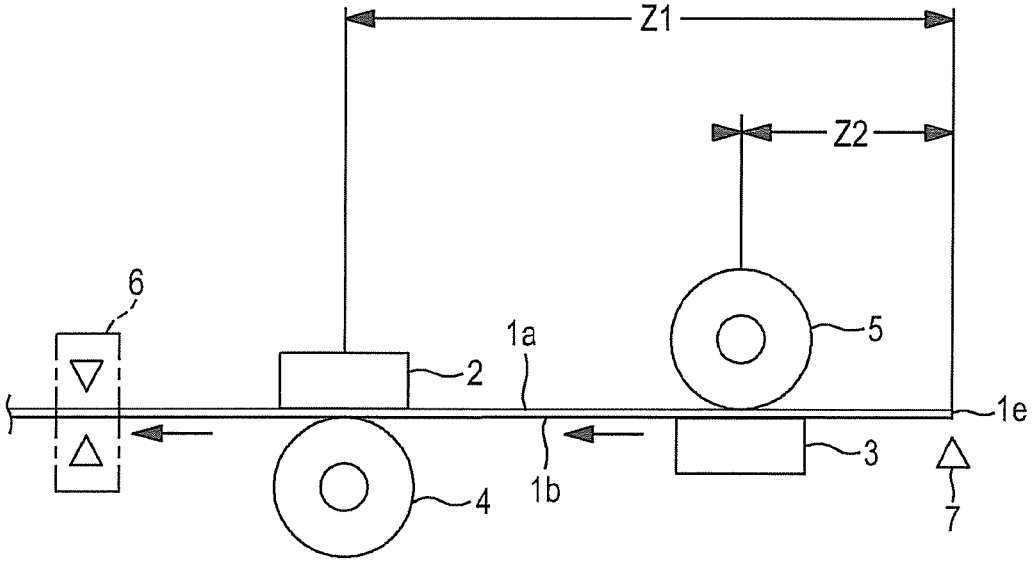
FIG. 6 is a diagram showing a situation where a thermal paper runs out in a thermal printer.

As the printing operation proceeds, the rolled thermal paper 1 may be running out and thus the end portion 1*e* of the rolled thermal paper 1 may be detected by the sensor 7, as shown in FIG. 6.

If the sensor 7 detects the end portion 1*e* of the thermal paper 1 in the course of printing the printing data D0 (=D1+D2), the CPU 11 may allow the first and second thermal heads 2 and 3 to continue the printing operation until the entire content of the printing data D0 is completely printed on the remaining portion of the thermal paper 1.

Figure 7:
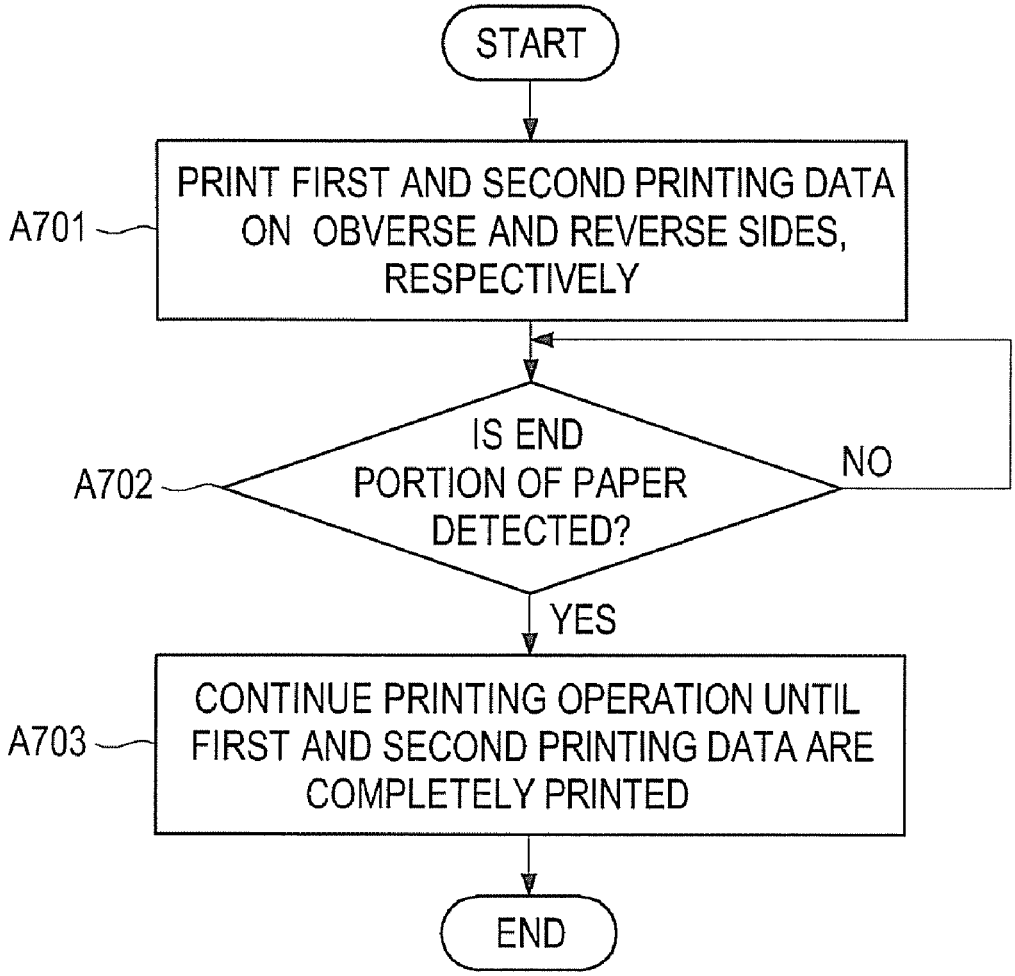
FIG. 7 is a flowchart explaining a print operation of a thermal printer according to an illustrative embodiment.

FIG. 7 is a flowchart showing an example sequence of the above-described print operation of a thermal printer according to an illustrative embodiment. In Act A701 shown in FIG. 7, the CPU 11 controls the feeding drive circuit 21 to drive the feeding of the thermal paper 1 along the paper path, and drives the first thermal head 2 associated with printing of the first printing data D1 so that 1st to 55th lines of the printing data is printed on the obverse side 1*a* of the thermal paper 1 (e.g., as shown in FIGS. 4 and 5). Similarly, the CPU 11 drives the second thermal head 3 associated with printing of the second printing data D2 so that 56th to 100th lines of the printing data is printed on the reverse side 1*b* of the thermal paper 1 (e.g., as shown in FIGS. 4 and 5). Thereafter, in Act A702, the CPU 11 determines whether the end portion 1*e* of the rolled thermal paper 1 is detected by the sensor 7. If the determination result in Act A702 is YES, i.e., when the end portion 1*e* of the paper is detected by the sensor 7, in Act A703, the CPU 11 controls the first and second heads 2 and 3 to continue a printing operation until the first and second printing data D1 and D2 are completely printed on the remaining portion of the thermal paper 1.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus and can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS (Operating System) in the apparatus.

In the above embodiments, the sum of the distance Z1 between the sensor 7 and the first thermal head 2 and the distance Z2 between the sensor 7 and the second thermal head 3 is no less than the length of an printing area on which at least one unit of printing data, such as the printing data D0, can be printed. As such, even if the running out of the thermal paper 1 is detected by the sensor 7, the remaining portion of the printing data D0 can be safely printed on the thermal paper 1 without requiring a loading of a new rolled thermal paper.

Therefore, this eliminates the need for performing a print resuming operation which includes waiting for loading of a new rolled thermal paper and then resuming the printing. Further, this reduces a time period until which a user has to wait for an issuance of a printed receipt, which may be caused by the print resuming operation. Furthermore, there is less likelihood of issuing two sheets of receipt, separately including parts of the printing data, to the user.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer, comprising:

a first head configured to print a first data set on a first side of a paper being conveyed along a paper path;

a second head configured to print a second data set on a second side of the paper being conveyed along the paper path;

a sensor provided at an upstream side of the first and second heads in the paper feeding direction along the paper path and configured to detect an end portion of the paper being conveyed along the paper path; and a control unit, when the end portion of the paper is detected by the sensor, configured to allow the first and second heads to continue a printing operation until the first and second data sets are printed on the remaining portion of the paper.

2. The printer of claim 1, wherein the second head is provided at the upstream side of the first head in the paper feeding direction along the paper path.

3. The printer of claim 1, wherein the paper is a double-sided thermal paper wound in a roll shape, the double-sided thermal paper having thermo-sensitive layers formed on the first and second sides thereof.

4. The printer of claim 1, wherein the control unit further comprises:

a first module configured to convert one unit of printing data into the first data set and the second data set; and a second module configured to drive the first and second heads to print information based on the first and second data sets, respectively.

5. The printer of claim 4, wherein a sum of a first length and a second length is no less than a length of a printing area on which at least one unit of printing data can be printed, the first length being a distance between the sensor and the first head and the second length being a distance between the sensor and the second head.

6. The printer of claim 5, wherein the first module converts one unit of printing data into the first data set and the second data set based on the first length and the second length.

7. The printer of claim 4, wherein each of the first and second heads comprises:

a heating element group having a plurality of heating elements arranged in a line, each configured to perform thermal transfer;

a latch circuit configured to latch respective lines of printing data based on a strobe signal provided from the second module; and a conduction control circuit configured to selectively perform conduction in each of the heating elements of the heating element group based on the respective lines of printing data latched by the latch circuit.

8. The printer of claim 4, wherein the one unit of printing data includes printing data corresponding to one transaction performed at an automatic teller machine.

9. The printer of claim 1, further comprising:

a first platen roller provided opposite the first head and, while the paper is interposed between the first platen roller and the first head, configured to press the paper toward the first head; and a second platen roller provided opposite the second head and, while the paper is interposed between the second platen roller and the first head, configured to press the paper toward the second head.

10. The printer of claim 1, further comprising:

a cutter provided at a downstream side of the first head in a paper feeding direction β along the paper path and configured to cut the paper printed by the first and second heads.

11. The printer of claim 1, wherein the first side of the paper includes a first blank area corresponding to a distance between the cutter and the first head, and the second side of the paper includes a second blank area corresponding to a length between the first head and the second head.

12. The printer of claim 1, wherein the sensor includes a reflective photo sensor.

13. A method of controlling a printer, comprising:

printing, through first and second heads, first and second data sets on first and second sides of a paper being conveyed along a paper path, respectively;

detecting, through a sensor, which is provided at an upstream side of the first and second heads in a paper feeding direction β, an end portion of the paper being conveyed along the paper path; and controlling, through a control unit, when the end of the paper is detected by the sensor, the first and second heads to continue a printing operation until the first and second data sets are printed on the remaining portion of the paper.

14. The method of claim 13, wherein the second head is mounted at the upstream side of the first head in the paper feeding direction β.

15. The method of claim 13, wherein the paper is a double-sided thermal paper wound in a roll shape, the double-sided thermal paper having thermo-sensitive layers formed on the first and second sides thereof.

16. The method of claim 13, wherein the controlling further comprises:

converting a one unit of printing data into the first data set and the second data set; and driving the first and second heads to print information based on the first and second data sets, respectively.

17. The method of claim 15, wherein the one unit of printing data includes printing data corresponding to one transaction performed at an automatic teller machine.

18. The method of claim 16, wherein a sum of a first length and a second length is no less than a length of a printing area on which at least one unit of printing data can be printed, the first length being a distance between the sensor and the first head and the second length being a distance between the sensor and the second head.

19. The method of claim 18, wherein the converting is performed based on the first length and the second length.

20. The method of claim 13, wherein the sensor includes a reflective photo sensor.

* * * * *